United States Patent [19]

Butler

[11] 4,266,733

[45] * May 12, 1981

[54] REPLACEABLE LINER FOR THE DISCHARGE ASSEMBLY OF A ROTARY GRINDING MILL OR THE LIKE

[76] Inventor: William J. Butler, 732 Old Howard Millroad, Duluth, Minn. 55804

[ * ] Notice: The portion of the term of this patent subsequent to Oct. 30, 1996, has been disclaimed.

[21] Appl. No.: 66,253

[22] Filed: Aug. 13, 1979

Related U.S. Application Data

[62] Division of Ser. No. 886,092, Mar. 13, 1978, Pat. No. 4,172,560.

[51] Int. Cl.[3] ..... B02C 17/18

[52] U.S. Cl. ..... 241/171; 241/70

[58] Field of Search ..... 241/70, 71, 79.2, 79.3, 241/171, 179, 181

[56] References Cited

U.S. PATENT DOCUMENTS

| | | | |
|---|---|---|---|
| 3,144,212 | 8/1964 | Klouers | 241/70 |
| 3,599,882 | 8/1971 | Sabaski et al. | 241/70 |
| 3,739,993 | 6/1973 | Nelson et al. | 241/70 |
| 3,758,041 | 9/1973 | Olson et al. | 241/171 X |
| 3,776,477 | 12/1973 | Hansen et al. | 241/179 X |
| 4,172,560 | 10/1979 | Butler | 241/70 X |

*Primary Examiner*—Howard N. Goldberg
*Attorney, Agent, or Firm*—Wicks & Nemer

[57] ABSTRACT

Replaceable liner for the discharge assembly of a rotary grinding mill or the like is disclosed, in the preferred embodiment, as including first, second, and inner most self-supporting box members. The first box member includes closed sides, bottom, and second end, and includes an open top and first end. The second box member includes closed sides, top, and bottom, and includes open ends. When the grate is removed from the first discharge casting, the second box member can be inserted within the first discharge casting and moved into the second and third discharge castings. Then the first box member can be placed within the first discharge casting. Thus, when the grate is attached to the first discharge casting, the first and second box members will be captured within the first and second discharge castings. The inner most box member is provided for installation in the three inner most castings which form the discharge cone of the discharge assembly. The inner most box member includes closed sides, top, and bottom, and includes open ends. The inner most box member further includes a discharge outlet formed by the top generally extending beyond the open end and terminating in a curved portion which follows and protects the three inner most castings. Further, one of the sides also extends beyond the open end of the inner most box member and terminates in the curved portion of the top such that the sides extend past the open end alternately in the mill and the inner most box members in adjacent tiers of discharge castings form a unitary outlet.

20 Claims, 7 Drawing Figures

PRIOR ART Fig 2

REPLACEABLE LINER FOR THE DISCHARGE ASSEMBLY OF A ROTARY GRINDING MILL OR THE LIKE

CROSS REFERENCE

This is a division of application Ser. No. 886,092 filed Mar. 13, 1978, by the same inventor and now U.S. Pat. No. 4,172,560.

BACKGROUND

The present invention relates generally to liners, more particularly to replaceable liners, and specifically to replaceable liners for the discharge end of a rotary grinding mill or the like.

It is well known that the discharge end of a rotary grinding mill or the like, such as shown in U.S. Pat. No. 3,599,882, is subjected to extreme abrasive wear due to the ground material passing therethrough. Discharge diaphram assemblies formed of discharge castings, grates, and wear plates, as in U.S. Pat. No. 3,599,882, are used in grinding mills in an attempt to maximize the useful life of the machines. However, it is necessary to form the discharge diaphram assembly out of very expensive material such as Ni-Hard iron. Furthermore, the discharge diaphram assembly of the prior art, after being worn by the ground material, had to be removed and replaced piece by piece, which is expensive in both labor and also down time in that the grinding mill cannot be operated for significant periods during replacement of the discharge diaphram assembly.

Thus, a need has arisen in the art for a replaceable liner for insertion into the discharge castings such that the liners can be inexpensively replaced with substantial savings in labor and down time and also allowing the discharge diaphram assembly to be made of less costly material.

Past attempts to provide such a replaceable liner have not proven successful and have, in instances, failed to remain in place at least in view of the extremely hostile environment.

SUMMARY

The present invention solves these and other problems in rotary grinding mills or the like by providing, in the preferred embodiment, a replaceable liner for insertion into the inner most castings comprising an inner most box member for installation in the inner most castings including a discharge outlet for protecting the inner most castings.

It is thus an object of the present invention to provide a replaceable liner for insertion into the discharge casting of a rotary grinding mill or the like.

It is a further object of the present invention to provide such a novel replaceable liner which can be inexpensively replaced within the discharge castings with substantial savings in labor and down time.

It is a further object of the present invention to provide such a novel replaceable liner which may be manufactured at a low cost and which maximizes wear before replacement.

It is a further object of the present invention to provide such a novel replacement liner which does not require the piece by piece removal of the discharge castings.

It is a further object of the present invention to provide such a novel replacement liner which protects the discharge castings from abrasive wear caused by the ground material passing through the discharge castings on its way out of the mill.

It is a further object of the present invention to provide such a novel replacement liner which protects the discharge cone of the discharge assembly of the mill.

These and further objects and advantages of the present invention will become clearer in light of the following detailed description of an illustrative embodiment of this invention described in connection with the drawings.

DESCRIPTION OF THE DRAWINGS

The illustrative embodiments may best be described by reference to the accompanying drawings where:

FIG. 2 is a diagramatic side view of the mill of FIG. 1 according to view line 2—2 of FIG. 1, with portions of the mill broken away.

FIG. 3 is a cross sectional view of a replaceable liner according to the teachings of the present invention for use with the mill of FIG. 1 or the like.

FIG. 7 is a perspective view of a replaceable liner according to the teachings of the present invention for installation in the discharge cone of the mill of FIG. 1 or the like.

Figure 1:
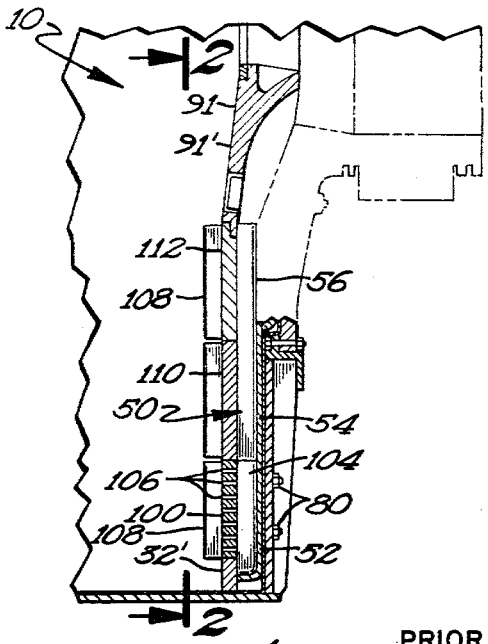
Fig 1 PRIOR ART
FIG. 1 shows a partial, diagramatic, longitudinal section of a grinding mill such as is illustrated in U.S. Pat. No. 3,599,882 and having a discharge assembly.
Figure 3:
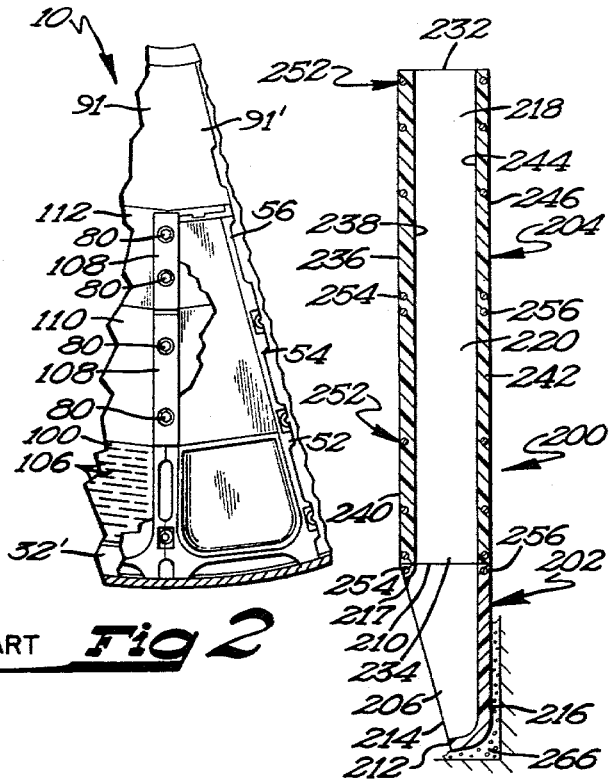
Figure 5:
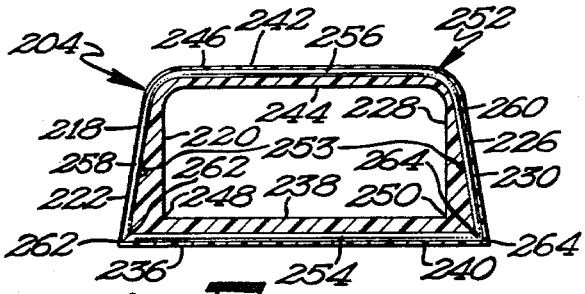
FIG. 5 is a cross sectional view of the liner of FIG. 4 according to section line 5—5 of FIG. 4.
Figure 4:
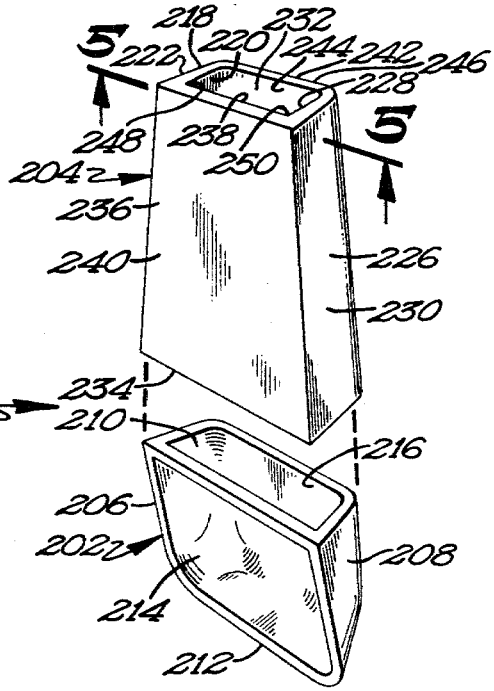
FIG. 4 is an exploded perspective view of the liner of FIG. 3.
Figure 6:
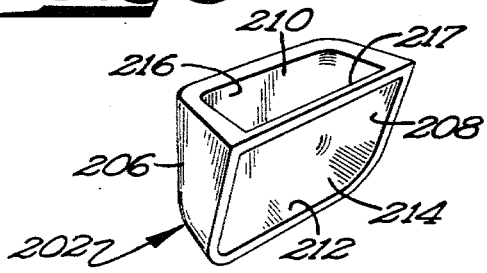
FIG. 6 is a perspective view of a part of the liner of FIG. 3.
Figure 7:
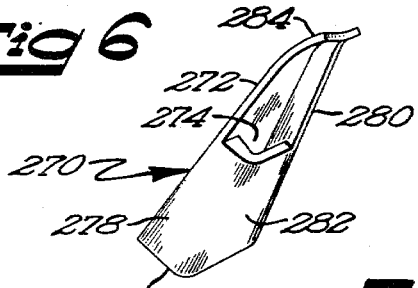

All figures are drawn for ease of explanation of the basic teachings of the present invention only; the extensions of the figures with respect to number, position, relationship, and dimensions of the parts to form the preferred embodiment will be explained or will be obvious from the explanation given.

Where used in the various figures of the drawings, the same numeral designates the same or similar parts in the present invention. Furthermore, when the terms "right", "left", "first", "second", "top", "bottom", and similar terms are used herein, it should be understood that these terms have reference only to the structure shown in the drawings as it would appear to a person viewing the drawings and are utilized only to facilitate describing the invention.

DESCRIPTION

The remaining disclosure of the present invention, including preferred embodiments, are incorporated herein by reference to application Ser. No. 886,092 filed Mar. 13, 1978, by William James Butler entitled "Replaceable Liner for the Discharge Assembly of a Rotary Grinding Mill or the Like", now U.S. Pat. No. 4,172,560, the parent application of the present invention.

What is claimed is:

1. In a discharge assembly adapted to be mounted inside the discharge end of a rotary grinding mill or the like comprising tiers of discharge castings extending circumferentially of the grinding mill or the like, with the discharge castings including outer, intermediate, and inner discharge castings, with the outer casting including a grate provided with passages and the inner discharge castings forming a discharge cone, the improvement comprising a replaceable liner for insertion into the discharge castings comprising, in combination: an inner most box member for installation in the discharge castings forming the discharge cone, with the inner most box member including a first closed side having an inside surface and an outside surface, a second closed side having an inside surface and an outside surface, a first open end, a second open end, a closed top having an inside surface and an outside surface, and a closed bottom having an inside surface and an outside surface, with the inner most box member further including a discharge outlet having an open bottom and a closed top, with the discharge outlet being formed by the closed top of the inner most box member extending beyond the first open end of the inner most box member and terminating in a curved portion which follows and protects the castings forming the discharge cone.

2. The replaceable liner of claim 1 wherein one of the closed sides of the inner most box member also extends beyond the first open end of the inner most box member and terminates in the curved portion of the top of the inner most box member such that the sides extend past the open end alternately in the mill and the inner most box members in adjacent tiers of discharge castings form a unitary outlet.

3. The replaceable liner of claim 1 wherein the angle of the corners formed between the inside surface of the top and the inside surfaces of the first and second sides of the inner most box member is approximately 90° for increasing the volume of the ground material path.

4. The replaceable liner of claim 1 or 3 further comprising reinforcing members embedded in the top, bottom, and first and second sides of the inner most box member for retaining the shape of and for preventing distortion of the inner most box member.

5. The replaceable liner of claim 4 wherein the reinforcing members include a top member embedded in the top of the box member, first and second side members embedded in the first and second sides of the box member, and a bottom member embedded in the bottom of the box member, with the reinforcing members having a shape corresponding to the shape of the outside surfaces of the top, bottom, and first and second sides of the box member, and the reinforcing member being located as close as possible to the outside surfaces of the top, bottom, and first and second sides of the box member and spaced as much as possible from the corners formed between the inside surface of the top and the inside surfaces of the first and second sides of the box member for allowing the maximum wear of the box member before exposing the reinforcing member.

6. The replaceable liner of claim 5 wherein the angle of the corners formed between the top member and the first and second side members of the reinforcing members is approximately 85°.

7. The replaceable liner of claim 5 wherein the outside surfaces of the first and second sides of the inner most box member taper towards each other from the top to the bottom.

8. The replaceable liner of claim 1 wherein the inner most box member is formed of urethane.

9. The replaceable liner of claim 1 wherein the top of the inner most box member has a thickness greater than the bottom of the inner most box member.

10. The replaceable liner of claim 1 or 2 further comprising, in combination: at least first and second, self-supporting box members, with the first box member including a first closed side, a second closed side, a first open end, a second closed end, an open top, and a closed bottom, with the second box member including a first closed side having an inside surface and an outside surface, a second closed side having an inside surface and an outside surface, a first open end, a second open end, a closed top having an inside surface and an outside surface, and a closed bottom having an inside surface and an outside surface, with the second box member having a shape complementary to the shape of the intermediate discharge casting, allowing insertion within the outer discharge casting when the grate is removed and into the intermediate discharge casting, and preventing movement of the second box member in the intermediate discharge casting in a first direction, and the first box member having a shape complementary to the outer discharge casting, allowing placement within the outer discharge casting and preventing movement of the second box member in the intermediate discharge casting in a second direction, for capturing the first and second box members within the outer and intermediate discharge castings when the grate is attached to the outer discharge casting.

11. The replaceable liner of claim 10 further comprising reinforcing members embedded in the top, bottom, and first and second sides of the box members for retaining the shape of and preventing distortion of the box members when installed within the discharge castings.

12. The replaceable liner of claim 11 wherein the reinforcing members in the second and inner most box members include a top member embedded in the top of the box member, first and second side members embedded in the first and second sides of the box member, and a bottom member embedded in the bottom of the box member, with the reinforcing members having a shape corresponding to the shape of the outside surfaces of the top, bottom, and first and second sides of the box member and the reinforcing member being located as close as possible to the outside surfaces of the top, bottom, and first and second sides of the box member and spaced as much as possible from the corners formed between the inside surface of the top and the inside surfaces of the first and second sides of the box member for allowing the maximum wear of the box member before exposing the reinforcing member.

13. The replaceable liner of claim 12 wherein the angle of the corners formed between the top member and the first and second side members of the reinforcing members is approximately 85°.

14. The replaceable liner of claim 12 wherein the angle of the corners formed between the inside surface of the top and the inside surfaces of the first and second sides of the box members is approximately 90° for increasing the volume of the ground material path.

15. The replaceable liner of claim 11 wherein the first box member includes a bar at the intersection of the first open end and the open top and wherein the reinforcing member in the first box member includes a top member embedded in the bar of the box member, first and second side members embedded in the first and second sides of the box member, and a bottom member embedded in the bottom of the box member, with the reinforcing member having a shape corresponding to the shape of the outside surfaces of the bar, bottom, and first and second sides of the box member, and the reinforcing member being located as close as possible to the outside surfaces of the bar, bottom, and first and second sides of the box member and spaced as much as possible from the corners formed between the inside surface of the bar and the inside surfaces of the first and second sides of the box member for allowing the maximum wear of the box member before exposing the reinforcing member.

16. The replaceable liner of claim 10 wherein the box members are formed of urethane.

17. The replaceable liner of claim 10 wherein the tops of the second and inner most box members have a thickness greater than the bottoms of the second and inner most box members.

18. In a discharge assembly adapted to be mounted inside the discharge end of a rotary grinding mill or the like comprising tiers of discharge castings extending circumferentially of the grinding mill or the like, with the discharge castings including outer, intermediate, and inner discharge castings, with the outer casting including a grate provided with passages, the intermediate discharge castings including a wear plate, and the inner discharge castings forming a discharge cone, with the outer, intermediate, and inner discharge castings, the grate, and the wear plate defining a discharge chamber, the improvement comprising replaceable liner for insertion into the discharge castings comprising, in combination: at least first, second, and inner most self-supporting box members; with the first box member including a first closed side, a second closed side, a first open end, a second closed end, an open top, and a closed bottom; with the second box member including a first closed side having an inside surface and an outside surface, a second closed side having an inside surface and an outside surface, a first open end, a second open end, a closed top having an inside surface and an outside surface, and a closed bottom having an inside surface and an outside surface, with the inner most box member including a first closed side having an inside surface and an outside surface, a second closed side having an inside surface and an outside surface, a first open end, a second open end, a closed top having an inside surface and an outside surface, and a closed bottom having an inside surface and an outside surface, with the inner most box member further including a discharge outlet having an open bottom and a closed top for discharging in a direction opposite to the open top of the first box member for installation into the inner discharge castings forming the discharge cone, with the second box member having a shape complementary to the shape of the intermediate discharge casting, allowing insertion within the outer discharge casting when the grate is removed and into the intermediate discharge casting, and preventing movement of the second box member in the intermediate discharge casting in a first direction, and the first box member having a shape complementary to the outer discharge casting, allowing placement within the outer discharge casting and preventing movement of the second box member in the intermediate discharge casting in a second direction, for capturing the first and second box members within the outer and intermediate discharge castings when the grate is attached to the outer discharge casting.

19. The replaceable liner of claim 18 wherein the closed top of the discharge outlet is formed by the closed top of the inner most box member extending beyond the open end of the inner most box member and terminating in a curved portion.

20. The replaceable liner of claim 19 wherein one of the closed sides of the inner most box member also extends beyond the first open end of the inner most box member and terminates in the curved portion of the top of the inner most box member such that the sides extend past the open end alternately in the mill such that the inner most box members in adjacent tiers of discharge castings form a unitary outlet.

* * * * *